US005846342A

United States Patent [19]

Aoyama et al.

[11] Patent Number: 5,846,342

[45] Date of Patent: Dec. 8, 1998

[54] SURFACE TREATMENT AGENT FOR ZINCIFEROUS-PLATED STEEL

[75] Inventors: Masayuki Aoyama; Takao Ogino, both of Kanagawa-ken, Japan

[73] Assignee: Henkel Corporation, Plymouth Meeting, Pa.

[21] Appl. No.: 687,390

[22] PCT Filed: Feb. 1, 1995

[86] PCT No.: PCT/US95/00977

§ 371 Date: Aug. 2, 1996

§ 102(e) Date: Aug. 2, 1996

[87] PCT Pub. No.: WO95/21277

PCT Pub. Date: Aug. 10, 1995

[30] Foreign Application Priority Data

Feb. 3, 1994 [JP] Japan ..... 6-011695

[51] Int. Cl.[6] ..... C23C 22/53

[52] U.S. Cl. ..... 148/271; 148/274

[58] Field of Search ..... 148/271, 243, 148/259, 274

[56] References Cited

FOREIGN PATENT DOCUMENTS

| | | |
|---|---|---|
| 22781 | 8/1979 | Japan . |
| 15541 | 3/1983 | Japan . |
| 33910 | 8/1986 | Japan . |

*Primary Examiner*—Sam Silverberg

*Attorney, Agent, or Firm*—Ernest G. Szoke; Wayne C. Jaeschke; Norvell E. Wisdom, Jr.

[57] ABSTRACT

A chromium-free aqueous liquid surface treatment agent that can impart both a good corrosion resistance and a good paint adherence to zinciferous-plated steel sheet contains as its essential components polyhydroxyaryl carboxylic acid and/or depside thereof and silane coupling agent with the formula $(YR)_mR_nSiX_{(4-m-n)}$, in which R denotes alkyl groups; X is the methoxy or ethoxy group; Y is the vinyl, amino, mercapto, glycidoxy, or methacryloxy group; m=1 to 3; and n=0 to (3−m). The total content of said essential components is preferably 1 to 50 weight %.

14 Claims, No Drawings

SURFACE TREATMENT AGENT FOR ZINCIFEROUS-PLATED STEEL

TECHNICAL FIELD

The invention relates to an optimized surface treatment agent that imparts both an excellent corrosion resistance and an excellent paint adherence to the surface of steel, especially steel sheet, plated with zinc or zinc-containing alloy (hereinafter abbreviated as zinciferous-plated steel). The invention will be described below primarily with respect to use on steel sheet, but it is to be understood that any other shape of steel substrate may also be treated according to the invention.

BACKGROUND ART

Zinciferous-plated steel sheet utilizes the principle of sacrificial zinc corrosion, which is a general method for preventing the corrosion of iron steel. Zinciferous-plated steel sheet is used in a broad range of applications, extending over the automotive, building material, and household electrical appliance sectors. However, the corrosion product generated when zinc corrodes in the atmosphere produces so-called white rust on the steel sheet, which leads to a deterioration in appearance. Moreover, this white rust also impairs paint adherence to the plated steel sheet.

These problems are generally solved by subjecting the surface of zinciferous-plated steel sheet to a chromate treatment with a treatment bath whose main components are chromic acid, dichromic acid, or a salt thereof. This treatment produces a highly corrosion-resistant and strongly paint-adherent chromate film.

Unfortunately, the hexavalent chromium present in the chromate treatment baths used on zinciferous-plated steel sheet has a direct negative effect on the human body. This, and the recent increased demand for environmental protection, has created a desire to avoid the use of chromate treatments. In addition, the use of chromate treatments requires the implementation of special waste water treatment as stipulated in the Water Pollution Prevention Law, which drives up costs as a whole. Finally, when discarded or abandoned, chromate-treated zinciferous-plated steel sheet is classified as a chromium-containing waste and therefore cannot be recycled.

One well-known non-chromate surface treatment method uses surface treatment agents based on tannic acid (tannic acid contains polyphenolic carboxylic acid). When zinciferous-plated steel sheet is treated with an aqueous solution of tannic acid, the zinc tannate produced by the reaction between tannic acid and zinc forms a protective coating. It is thought that the corrosion resistance of the zinciferous-plated steel sheet is improved through the action of this protective coating as a barrier to the infiltration of corrosive substances.

Japanese Patent Publication Number Sho 54-22781 [22,781/1979] teaches a tannic acid-based surface treatment method comprising the treatment of zinciferous-plated steel sheet with an aqueous solution that contains at least tannic acid and silica sol. This method forms an ultrathin surface film that has a rust-inhibiting activity. The problem with this method is that this film still cannot deliver a satisfactory corrosion resistance.

Otherwise, Japanese Patent Publication Number Sho 61-33910 [33,910/1986] teaches a method in which zinc-containing metal articles are first treated with a strongly alkaline (pH≧12.5) aqueous solution and are thereafter treated with an acidic aqueous solution whose main component is tannic acid. While the coating produced by this method has a relatively good corrosion resistance, this method requires a strongly alkaline treatment and a water rinse prior to the tannic acid treatment. This results in a poor productivity and poor economics.

Another surface treatment method is disclosed in Japanese Patent Publication Number Sho 58-15541 [15,541/1983]. In this method, the surface of zinciferous-plated steel sheet is treated with an aqueous solution containing organosilane coupling agent and one or both of water glass and sodium silicate. The surface film yielded by this method exhibits a good primary adherence, but a poor secondary adherence and a poor corrosion resistance.

Thus, no chromium-free surface treatment agent introduced to date is able to impart both an excellent corrosion resistance and an excellent paint adherence to zinciferous-plated steel sheet.

DISCLOSURE OF THE INVENTION

PROBLEMS TO BE SOLVED BY THE INVENTION

The present invention takes as its object the introduction of a chromium-free surface treatment agent that solves the problems described above for the prior art by simultaneously providing the excellent corrosion resistance and excellent paint adherence required for zinciferous-plated steel sheet.

SUMMARY OF THE INVENTION

A coating having both a high corrosion resistance and a strong paint adherence can be produced by treating the surface of zinciferous-plated steel sheet with a surface treatment agent that contains a particular type of silane coupling agent and at least one selection from polyhydroxyaryl carboxylic acids and depsides of polyhydroxyaryl carboxylic acids. The invention was achieved based on this finding.

In specific terms, the surface treatment agent according to the invention for zinciferous-plated steel sheet characteristically comprises, preferably consists essentially of, or more preferably consists of, water and the following essential components:

(A) a component selected from the group consisting of polyhydroxyaryl carboxylic acids and depsides of polyhydroxyaryl carboxylic acids; and (B) a component selected from the group consisting of silane coupling agents with the following general formula (I):

$$(YR)_mR_nSiX_{(4-m-n)} \quad (I),$$

in which R denotes an alkyl group, which may be the same or different from one of the m YR and the n R moieties to another; X denotes a methoxy or ethoxy moiety; Y denotes a moiety selected from the group consisting of vinyl, amino, mercapto, glycidoxy, and methacryloxy moieties, which may be the same or different from one of the m YR moieties to another; m is an integer with a value from 1 to 3; and n is an integer with a value of 0 to (3−m); and optionally, one or more of:

(C) water miscible monoalcohols;

(D) metal cations with a valence of two or more; and (E) accelerator anions.

It is preferred, furthermore, that the total content of essential components (A) and (B) in the surface treatment agent according to the invention should be 1 to 50 weight %.

DETAILED DESCRIPTION OF THE INVENTION

Zinciferous-plated steel which can be treated with the surface treatment agent of the invention encompasses steel coated with zinc or a zinc alloy, for example, Zn/Fe alloy, Zn/Ni alloy, Zn/Al alloy, and the like.

Polyhydroxyaryl carboxylic acids usable by the present invention must have at least two hydroxyl substituents and at least one carboxyl substituent on a single aromatic nucleus. Such acids are exemplified by gallic acid, protocatechuic acid, gallocarboxylic acid, and the like. Suitable as the depsides of polyhydroxyaryl carboxylic acids are, for example, meta-digallic acid, trigallic acid, diploschistesic acid, tannin, tannic acid, and so forth. The tannin used in the present invention is a general term for substances extractable by hot water from the seeds, fruits, shells, leaves, roots, wood, and bark of plants and able to convert raw animal hides into leather. Tannic acid is the tannin obtained from Chinese or Turkish nutgall, etc. The type and quantity of addition of these substances is not critical.

Any silane coupling agent that has a chemical structure with general formula (I) may be used in the present invention. For example, compounds from the following groups (a)–(c) can be used and are generally preferred.

(a) glycidoxy-functional silane coupling agents e.g., 3-glycidoxypropyl trimethoxy silane 3-glycidoxypropyl methyl dimethoxy silane 2-(3,4-epoxycyclohexyl)ethyl trimethoxy silane (b) amino-functional silane coupling agents e.g., N-(2-aminoethyl)-3-aminopropyl methyl dimethoxy silane N-(2-aminoethyl)-3-aminopropyl trimethoxy silane 3-aminopropyl triethoxy silane (c) mercapto-functional silane coupling agents e.g., 3-mercaptopropyl trimethoxy silane.

No specific restrictions apply to the content of these silane coupling agents in the surface treatment agent.

The surface treatment agent of the invention may in general be prepared by dissolving or dispersing the aforementioned essential components in water. While the total concentration of the essential components is not specifically restricted, the sum of the concentrations of the essential components, i.e., silane coupling agent+polyhydroxyaryl carboxylic acid(s) and/or depside(s) of polyhydroxyaryl carboxylic acid(s) is preferably 1 to 50 weight %. When the total amount of these essential components falls below 1 weight %, the treated zinciferous-plated steel sheet will not always exhibit the good corrosion resistance that is the goal of the present invention. On the other hand, a total amount of essential components in excess of 50 weight % is uneconomical because no further improvement in corrosion resistance is obtained for the treated zinciferous-plated steel sheet at such values. The weight ratio between subject essential components is preferably {polyhydroxyaryl carboxylic acid(s) and/or depside(s) thereof}: {silane coupling agent}=10:1 to 1:2, or preferably 10:1 to 1:1.

The surface treatment agent according to the invention may contain additives in addition to the essential components already discussed above. Metal ions may be added in order to improve the insolubility of the treated zinciferous-plated steel sheet. Metal ions usable for this purpose are exemplified by iron, nickel, manganese, cobalt, zinc, aluminum, calcium, and magnesium ions, with zinc and magnesium ions being particularly preferred. In addition, a reaction accelerator may be added in order to accelerate the reaction with the surface of the zinciferous-plated steel sheet. Preferred for use as this reaction accelerator are, for example, phosphate ions, nitrate ions, fluoride ions, and organic acids other than those that are part of component (A). Fluoride ions are particularly preferred as the reaction accelerator. Finally, no particular restrictions apply to the sources of the ions and quantities of addition for the described additives.

An additive that is generally preferred is optional component (C) as described above, of which methanol is the most preferred embodiment. Independently, a concentration of optional component (C) in the range from 1 to 30, more preferably 5 to 15, or still more preferably 9 to 11, weight % is preferred in the treatment compositions according to the invention.

No particular restriction obtains on the method for treating zinciferous-plated steel sheet using the surface treatment agent of the invention, and, for example, immersion, spray, and roll coating methods are applicable. Nor is the treatment temperature or treatment time crucial, but in general the treatment temperature is preferably 10° C. to 40° C. and the treatment time is preferably 0.1 to 10 seconds.

Zinciferous-plated steel sheet treated with the surface treatment agent of the invention exhibits both an excellent corrosion resistance and an excellent paint adherence. In regard to the improved corrosion resistance, the polyhydroxyaryl carboxylic acid or depside thereof in the treatment agent is believed to react with the zinc to form a protective coating on the surface of the zinciferous-plated steel sheet. This protective coating then would prevent the infiltration of corrosive substances, thus yielding the improved corrosion resistance. The improved paint adherence is believed to occur as the result of adsorption of the functional groups in the silane coupling agent to the surface of the zinciferous-plated steel sheet.

The invention is explained in greater detail below through working examples, which, however, should not be construed as placing particular limits on the scope of the invention.

EXAMPLES

The following materials and procedure for cleaning the steel sheet were used in the examples.

1. Test materials

The following were used as the zinciferous-plated steel sheet substrates: commercial steel sheet (sheet thickness=0.6 mm) hot-dip galvanized on both sides (denoted below as "HDG" material, coating weight=40 g/m$^2$) or electrogalvanized on both sides (denoted below as "EG" material, coating weight=20 g/m$^2$).

2. Cleaning procedure

A moderately alkaline degreaser (FINECLEANER™4336, commercially available from Nihon Parkerizing Company, Limited, Tokyo) was used a concentration of 20 g/L. The dirt and oil adhering on the surface were removed by spraying the zinciferous-plated steel sheet with the aqueous degreaser solution using a treatment temperature of 60° C. and a treatment time of 20 seconds. The alkali remaining on the surface of the treated steel sheet was then washed off using tap water to yield the clean zinciferous-plated steel sheet surface.

Example 1

The EG material, cleaned as described above, was immersed at room temperature for 20 seconds in a surface treatment bath prepared by dissolving 0.5 weight % of gallic acid, 0.5 weight % of 3-glycidoxypropyl trimethoxy silane, and 10 weight % of methanol in deionized water. This was followed by draining and drying to a sheet temperature of 100° C.

Example 2

The treatment procedure of Example 1 was executed on the HDG material instead of the EG material used in Example 1.

Example 3

The surface of the EG material, cleaned as described above, was roll coated with a surface treatment bath prepared by dissolving 5.0 weight % of Chinese nutgall tannin, 3.4 weight % of 3-glycidoxypropyl methyl dimethoxy silane, and 10 weight % methanol in deionized water. This was followed by drying to a sheet temperature of 100° C.

Example 4

The treatment procedure of Example 3 was executed on the HDG material instead of the EG material used in Example 3.

Example 5

The surface of the EG material, cleaned as described above, was roll coated with a surface treatment bath prepared by dissolving 10 weight % of protocatechuic acid, 2.5 weight % of 3-aminopropyl triethoxy silane, and 10 weight % of methanol in deionized water. This was followed by drying to a sheet temperature of 100° C.

Example 6

The treatment procedure of Example 5 was executed on the HDG material instead of the EG material used in Example 5.

Example 7

The EG material, cleaned as described above, was immersed at room temperature for 20 seconds in a surface treatment bath prepared by dissolving 18.0 weight % of quebracho tannin, 32.0 weight % of 3-mercaptopropyl trimethoxy silane, and 10 weight % of methanol in deionized water. This was followed by draining with a wringer roll and drying to a sheet temperature of 100° C.

Example 8

The treatment procedure of Example 7 was executed on the HDG material instead of the EG material used in Example 7.

Comparative Example 1

The EG material, cleaned as described above, was immersed at room temperature for 20 seconds in a comparative treatment bath prepared by dissolving 5.0 weight % of Chinese nutgall tannin in deionized water. This was followed by draining using a wringer roll and drying to a sheet temperature of 100° C.

Comparative Example 2

The treatment procedure of Comparative Example 1 was executed on the HDG material instead of the EG material used in Comparative Example 1.

Comparative Example 3

The EG material, cleaned as described above, was sprayed for 10 seconds at room temperature with a comparative treatment bath prepared by dissolving 5.0 weight % of 3-glycidoxypropyltrimethoxysilane, 10 weight % of methanol, and 25 weight % of 20 % silicic acid sol in deionized water. This was followed by draining using a wringer roll and drying to a sheet temperature of 100° C.

Comparative Example 4

The treatment procedure of Comparative Example 3 was executed on the HDG material instead of the EG material used in Comparative Example 3.

Evaluation Testing

The products from Examples 1 to 8 and Comparative Examples 1 to 4 were tested by the following methods.

(1) Corrosion resistance

The resistance to white rusting was tested by the salt spray test of JIS Z-2371. The following scale was employed to report the results.

+++: no abnormalities

++: area of white rust development less than 5%

+: area of white rust development is 5 to 10% x: area of white rust development is 11 to 50% xx: area of white rust development is 51% or greater (2) Paint adherence

After treatment with a surface treatment agent as described above, the zinciferous-plated steel sheet was coated with paint (Delicon #700 from Dainippon Toryo Kabushiki Kaisha) and baked at 140° C. for 20 minutes to yield a 25 micrometer-thick paint film.

(i) Primary paint adherence

Crosscut test: a crosshatch pattern of 1 mm×1 mm squares was cut in the paint film on the product's surface using an NT cutter, and the number of squares remaining after peeling with adhesive tape was counted.

Crosscut/Erichsen test: the specimen was extruded 5 mm after the crosscut evaluation, and the number of squares remaining after peeling with adhesive tape was counted.

(ii) Secondary paint adherence

The painted sheet was immersed in boiling pure water for 2 hours and was then evaluated by the crosscut test and crosscut/Erichsen test as described above for primary paint adherence.

The results of these tests are shown in Table 1 below. The results in Table 1 confirm that excellent values for both corrosion resistance and paint adherence (both primary and secondary) were obtained for Examples 1 to 8 of the invention. In Comparative Examples 1 to 4, on the other hand, no treatment gave good results in all the tests conducted, and the results from the secondary paint adherence tests were particularly inferior to the results given by the invention examples.

TABLE 1

RESULTS OF THE EVALUATION TESTS

| Example ("E") or Comparison Example ("CE") Number | Corrosion Resistance, 24 Hr. Salt Spray | Primary Paint Adherence | | Secondary Paint Adherence | |
|---|---|---|---|---|---|
| | | Crosscut Only | Crosscut/ Erichsen | Crosscut Only | Crosscut/ Erichsen |
| E1 | ++ | 100/100 | 100/100 | 100/100 | 100/100 |
| E2 | ++ | 100/100 | 100/100 | 100/100 | 100/100 |
| E3 | +++ | 100/100 | 100/100 | 100/100 | 100/100 |
| E4 | +++ | 100/100 | 100/100 | 100/100 | 100/100 |

TABLE 1-continued

RESULTS OF THE EVALUATION TESTS

| Example ("E") or Comparison Example ("CE") Number | Corrosion Resistance, 24 Hr. Salt Spray | Primary Paint Adherence | | Secondary Paint Adherence | |
|---|---|---|---|---|---|
| | | Crosscut Only | Crosscut/ Erichsen | Crosscut Only | Crosscut/ Erichsen |
| E5 | +++ | 100/100 | 100/100 | 100/100 | 99/100 |
| E6 | +++ | 100/100 | 100/100 | 100/100 | 98/100 |
| E7 | +++ | 100/100 | 100/100 | 100/100 | 97/100 |
| E8 | +++ | 100/100 | 100/100 | 100/100 | 96/100 |
| CE1 | + | 100/100 | 100/100 | 88/100 | 47/100 |
| CE2 | + | 100/100 | 100/100 | 82/100 | 51/100 |
| CE3 | xx | 100/100 | 100/100 | 88/100 | 29/100 |
| CE4 | xx | 100/100 | 100/100 | 80/100 | 33/100 |

Notes for Table 1
The results reported for the crosscut and crosscut/Erichsen tests are the number of squares remaining unpeeled after tape peeling before the virgule ("/") out of the number of total squares after the virgule.

Benefits of the Invention

Zinciferous-plated steel treated with the surface treatment agent according to the invention exhibits an excellent performance in both critical areas of corrosion resistance and paint adherence. The surface treatment agent of the invention is also very safe and highly advantageous in terms of environmental protection and recyclability. In particular, since it is clear that future restrictions on solvents will necessitate a change from solvent-based cleaning to water-based cleaning, the treatment agent of the invention will be particularly effective in those sectors in which environmental problems might occur due to chromium elution from the surface of chromated zinciferous-plated steel sheet.

The invention claimed is:

1. An aqueous liquid surface treatment composition for zinciferous-plated steel, said composition comprising water and:

(A) a component selected from the group consisting of polyhydroxyaryl carboxylic acids and depsides of polyhydroxyaryl carboxylic acids;

(B) a component selected from the group consisting of silanes conforming to the general formula (I):

$$(YR)_mR_nSiX_{(4-m-n)}, \quad (I)$$

in which R denotes an alkyl group, which may be the same or different from one of the m YR and the n R moieties to another; X denotes a methoxy or ethoxy moiety; Y denotes a moiety selected from the group consisting of vinyl, amino, mercapto, and glycidoxy, and methacryloxy moieties, which may be the same or different from one of the m YR moieties to another, m is an integer with a value from 1 to 3; and n is an integer with a value of 0 to (3−m); and (C) from 1 to 30% by weight of a component selected from water-miscible monoalcohols.

2. A composition according to claim 1, wherein components (A) and (B) jointly constitute from 1 to 50 weight % of the composition.

3. A composition according to claim 2, wherein Y is selected from the group consisting of glycidoxy, amino, and mercapto.

4. A composition according to claim 3, comprising as component (C) from 9 to 11 weight % of methanol.

5. A composition according to claim 2, comprising from 5 to 15 weight % of component (C).

6. A composition according to claim 1, wherein Y is selected from the group consisting of glycidoxy, amino, and mercapto.

7. A process for treating a steel substrate by contacting the substrate with a composition according to claim 6.

8. A process according to claim 7, wherein the temperature of the composition during contact is from 10 to 40 ° C. and the time of contact is from 0.1 to 10 seconds.

9. A process for treating a steel substrate by contacting the substrate with a composition according to claim 5.

10. A process for treating a steel substrate by contacting the substrate with a composition according to claim 4.

11. A process for treating a steel substrate by contacting the substrate with a composition according to claim 3.

12. A process for treating a steel substrate by contacting the substrate with a composition according to claim 2.

13. A process for treating a steel substrate by contacting the substrate with a composition according to claim 1.

14. A process according to claim 13, wherein the temperature of the composition during contact is from 10 to 40° C. and the time of contact is from 0.1 to 10 seconds.

* * * * *